US008631650B2

(12) United States Patent
Verkuilen et al.

(10) Patent No.: US 8,631,650 B2
(45) Date of Patent: Jan. 21, 2014

(54) HYDRAULIC SYSTEM AND METHOD FOR CONTROL

(75) Inventors: Michael T. Verkuilen, Germantown Hills, IL (US); John J. Krone, Peoria, IL (US); Douglas W. Koehler, Peoria, IL (US); James A. Aardema, Plymouth, MN (US)

(73) Assignee: Caterpillar Inc., Peoria, IL (US)

( * ) Notice: Subject to any disclaimer, the term of this patent is extended or adjusted under 35 U.S.C. 154(b) by 811 days.

(21) Appl. No.: 12/874,243

(22) Filed: Sep. 2, 2010

(65) Prior Publication Data

US 2011/0072809 A1 Mar. 31, 2011

Related U.S. Application Data

(60) Provisional application No. 61/245,709, filed on Sep. 25, 2009.

(51) Int. Cl.
*F15B 13/02* (2006.01)

(52) U.S. Cl.
USPC ..... 60/422; 60/459

(58) Field of Classification Search
USPC ..... 60/420, 422, 459, 484
See application file for complete search history.

(56) References Cited

U.S. PATENT DOCUMENTS 3,366,202 A 1/1968 James
3,590,861 A 7/1971 Chittenden et al.
3,733,818 A * 5/1973 Veres ..... 60/422
4,046,270 A 9/1977 Baron et al.
4,222,409 A 9/1980 Budzich
4,250,794 A 2/1981 Haak et al.
4,416,187 A 11/1983 Nystrom
4,437,385 A 3/1984 Kramer et al.
4,440,191 A 4/1984 Hansen
4,480,527 A 11/1984 Lonnemo
4,581,893 A 4/1986 Lindbom
4,586,330 A 5/1986 Watanabe et al.
4,623,118 A 11/1986 Kumar
4,662,601 A 5/1987 Andersson
4,706,932 A 11/1987 Yoshida et al.
4,747,335 A 5/1988 Budzich
4,799,420 A 1/1989 Budzich
5,134,853 A * 8/1992 Hirata et al. ..... 60/420
5,137,254 A 8/1992 Aardema et al.
5,152,142 A 10/1992 Budzich
5,211,196 A 5/1993 Schwelm
5,287,794 A 2/1994 Andersson
5,289,679 A * 3/1994 Yasuda ..... 60/422
5,297,381 A 3/1994 Eich et al.
5,313,873 A 5/1994 Gall et al.
5,333,449 A 8/1994 Takahashi et al.
5,350,152 A 9/1994 Hutchison et al.
5,366,202 A 11/1994 Lunzman
5,428,958 A 7/1995 Stenlund (Continued)

FOREIGN PATENT DOCUMENTS

DE 3813020 11/1989
EP 1538361 6/2005

(Continued)

*Primary Examiner* — Thomas E Lazo

(57) ABSTRACT

A hydraulic system is disclosed having at least two hydraulic circuits. The disclosed system apportions flow between the two hydraulic circuits based on an assumed flow rate that is held constant in both power-limited and non-power-limited conditions.

20 Claims, 2 Drawing Sheets

(56) References Cited

U.S. PATENT DOCUMENTS

| | | | | |
|---|---|---|---|---|
| 5,447,093 | A | 9/1995 | Budzich | |
| 5,477,677 | A | 12/1995 | Kmavek | |
| 5,537,818 | A | 7/1996 | Hosseini et al. | |
| 5,553,452 | A | 9/1996 | Snow et al. | |
| 5,568,759 | A | 10/1996 | Aardema | |
| 5,678,470 | A | 10/1997 | Koehler et al. | |
| 5,701,933 | A | 12/1997 | Lunzman | |
| 5,813,226 | A | 9/1998 | Krone | |
| 5,813,309 | A | 9/1998 | Taka et al. | |
| 5,813,312 | A * | 9/1998 | Arai et al. | 91/516 |
| 5,857,330 | A | 1/1999 | Ishizaki et al. | |
| 5,868,059 | A | 2/1999 | Smith | |
| 5,878,647 | A | 3/1999 | Wilke et al. | |
| 5,890,362 | A | 4/1999 | Wilke | |
| 5,896,737 | A | 4/1999 | Dyer | |
| 5,947,140 | A | 9/1999 | Aardema et al. | |
| 5,960,695 | A | 10/1999 | Aardema et al. | |
| 6,009,708 | A | 1/2000 | Miki et al. | |
| 6,026,730 | A | 2/2000 | Yoshida et al. | |
| 6,082,106 | A | 7/2000 | Hamamoto | |
| 6,216,456 | B1 | 4/2001 | Mitchell | |
| 6,367,365 | B1 | 4/2002 | Weichert et al. | |
| 6,381,946 | B1 | 5/2002 | Wernberg et al. | |
| 6,446,433 | B1 | 9/2002 | Holt et al. | |
| 6,467,264 | B1 | 10/2002 | Stephenson et al. | |
| 6,502,393 | B1 | 1/2003 | Stephenson et al. | |
| 6,502,500 | B2 | 1/2003 | Yoshino | |
| 6,516,614 | B1 | 2/2003 | Knoll | |
| 6,598,391 | B2 | 7/2003 | Lunzman et al. | |
| 6,619,183 | B2 | 9/2003 | Yoshino | |
| 6,655,136 | B2 | 12/2003 | Holt et al. | |
| 6,662,705 | B2 * | 12/2003 | Huang et al. | 91/433 |
| 6,691,603 | B2 | 2/2004 | Linerode et al. | |
| 6,694,860 | B2 | 2/2004 | Yoshino | |
| 6,715,402 | B2 | 4/2004 | Pfaff et al. | |
| 6,715,403 | B2 | 4/2004 | Hajek, Jr. et al. | |
| 6,718,759 | B1 | 4/2004 | Tabor | |
| 6,725,131 | B2 | 4/2004 | Lunzman | |
| 6,732,512 | B2 | 5/2004 | Pfaff et al. | |
| 6,748,738 | B2 | 6/2004 | Smith | |
| 6,761,029 | B2 | 7/2004 | Linerode | |
| 7,146,808 | B2 * | 12/2006 | Devier et al. | 60/422 |
| 7,908,853 | B2 * | 3/2011 | Budde et al. | 60/422 |
| 2003/0106423 | A1 | 6/2003 | Hajek, Jr. et al. | |
| 2003/0121256 | A1 | 7/2003 | Mather | |
| 2003/0121409 | A1 | 7/2003 | Lunzman et al. | |
| 2003/0125840 | A1 | 7/2003 | Lunzman et al. | |
| 2003/0196545 | A1 | 10/2003 | Jensen et al. | |
| 2004/0055288 | A1 | 3/2004 | Pfaff et al. | |
| 2004/0055289 | A1 | 3/2004 | Pfaff et al. | |
| 2004/0055452 | A1 | 3/2004 | Tabor | |
| 2004/0055453 | A1 | 3/2004 | Tabor | |
| 2004/0055454 | A1 | 3/2004 | Pfaff et al. | |
| 2004/0055455 | A1 | 3/2004 | Tabor et al. | |

FOREIGN PATENT DOCUMENTS

| | | |
|---|---|---|
| JP | 02613041 | 5/1997 |
| JP | 10306677 | 11/1998 |
| JP | 1152155 | 11/2001 |

* cited by examiner

HYDRAULIC SYSTEM AND METHOD FOR CONTROL

RELATED APPLICATIONS

This application is based upon and claims the benefit of priority from U.S. Provisional Application No. 61/245,709 by Michael Todd Verkuilen et al., filed Sep. 25, 2009, the contents of which are expressly incorporated herein by reference.

TECHNICAL FIELD

The present disclosure relates generally to a hydraulic system, and more particularly, to a hydraulic system having multiple circuits.

BACKGROUND

Hydraulic systems are often used to control the operation of hydraulic actuators of machines. These hydraulic systems typically include valves, arranged within hydraulic circuits, fluidly connected between the actuators and pumps. These valves may each be configured to control a flow rate and direction of pressurized fluid to or from respective chambers within the actuators.

In some instances, multiple actuators may be connected to a common pump. During actuation of multiple actuators one actuator may require a significantly higher pressure from the pump than other actuators. Actuation of one such actuator may also create undesirable pressure or flow conditions in other parts of the system. The pressure and flow of the fluid provided to each actuator can be controlled, in part, by valves between the pump and the actuator. It is generally desirable to control the valves in a way that improves the efficiency of the system.

One method of reducing pressure fluctuations in hydraulic systems is described in U.S. Pat. No. 5,878,647 ("the '647 patent") issued to Wilke et al. While the hydraulic circuit described in the '647 patent may reduce pressure fluctuations, it may also result in unnecessarily high system pressure.

SUMMARY OF THE INVENTION

A hydraulic system is disclosed having a source of pressurized fluid, and first and second hydraulic circuits configured to receive pressurized fluid from the source. The hydraulic system further includes a controller configured to determine a requested flow for the first circuit, determine a requested flow for the second circuit, and apportion pressurized fluid from the source between the first circuit and the second circuit based on a predetermined assumed available flow rate, wherein the predetermined assumed available flow rate is greater than an actual flow rate of the source.

DETAILED DESCRIPTION

Figure 1:
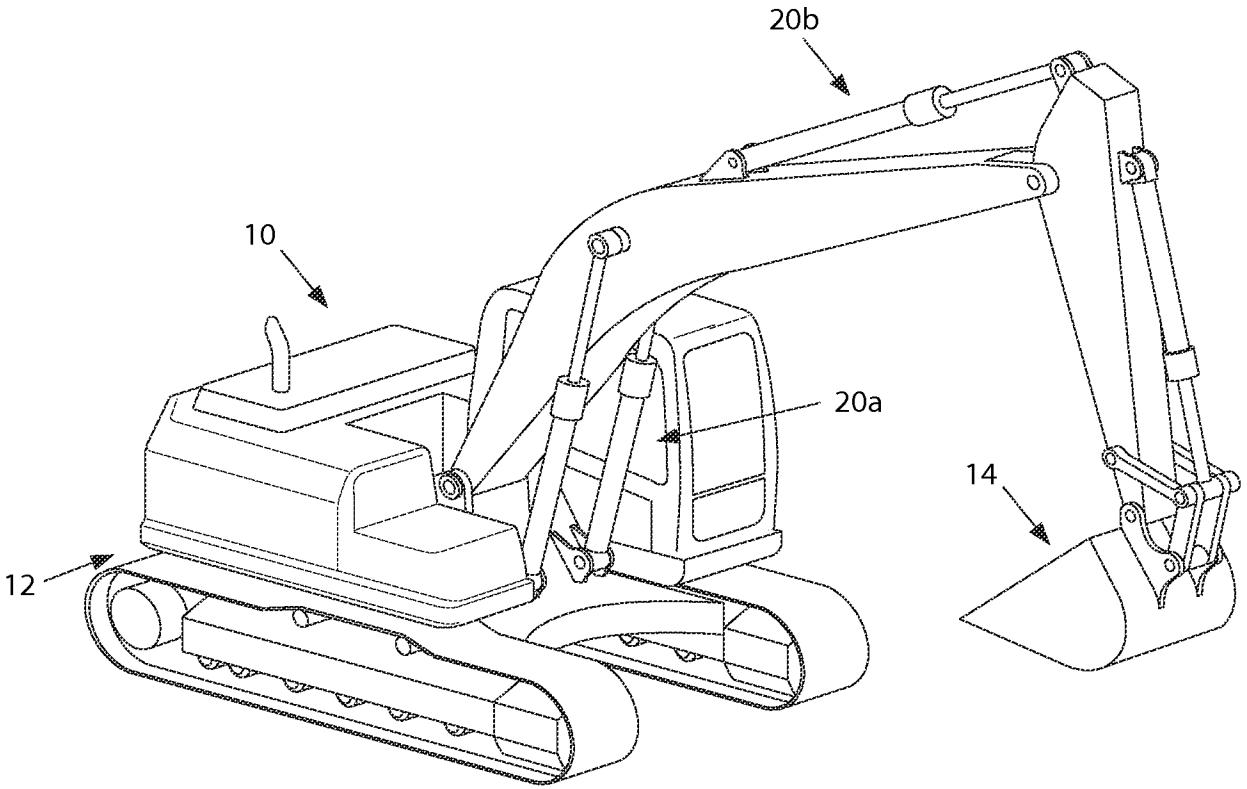
FIG. 1 is a diagrammatic illustration of a disclosed machine.

FIG. 1 illustrates an exemplary machine 10. Machine 10 may be a fixed or mobile machine that performs some type of operation associated with an industry such as mining, construction, farming, or any other industry known in the art. For example, machine 10 may be an earth-moving machine such as a dozer, a loader, a backhoe, an excavator, a motor grader, a dump truck, or any other earth moving machine. Machine 10 may also include a generator set, a pump, a marine vessel, or any other suitable operation-performing machine. Machine 10 may include a frame 12, an implement 14, and hydraulic actuators 20*a*, 20*b* connected between implement 14 and frame 12. Alternatively, hydraulic actuator 20*a* may be connected between implement 14 and frame 12 while hydraulic actuator 20*b* may be connected between a separate implement (not shown) and frame. Machine 10 may also include more than the two actuators 20*a*, 20*b* specifically discussed herein.

Figure 2:
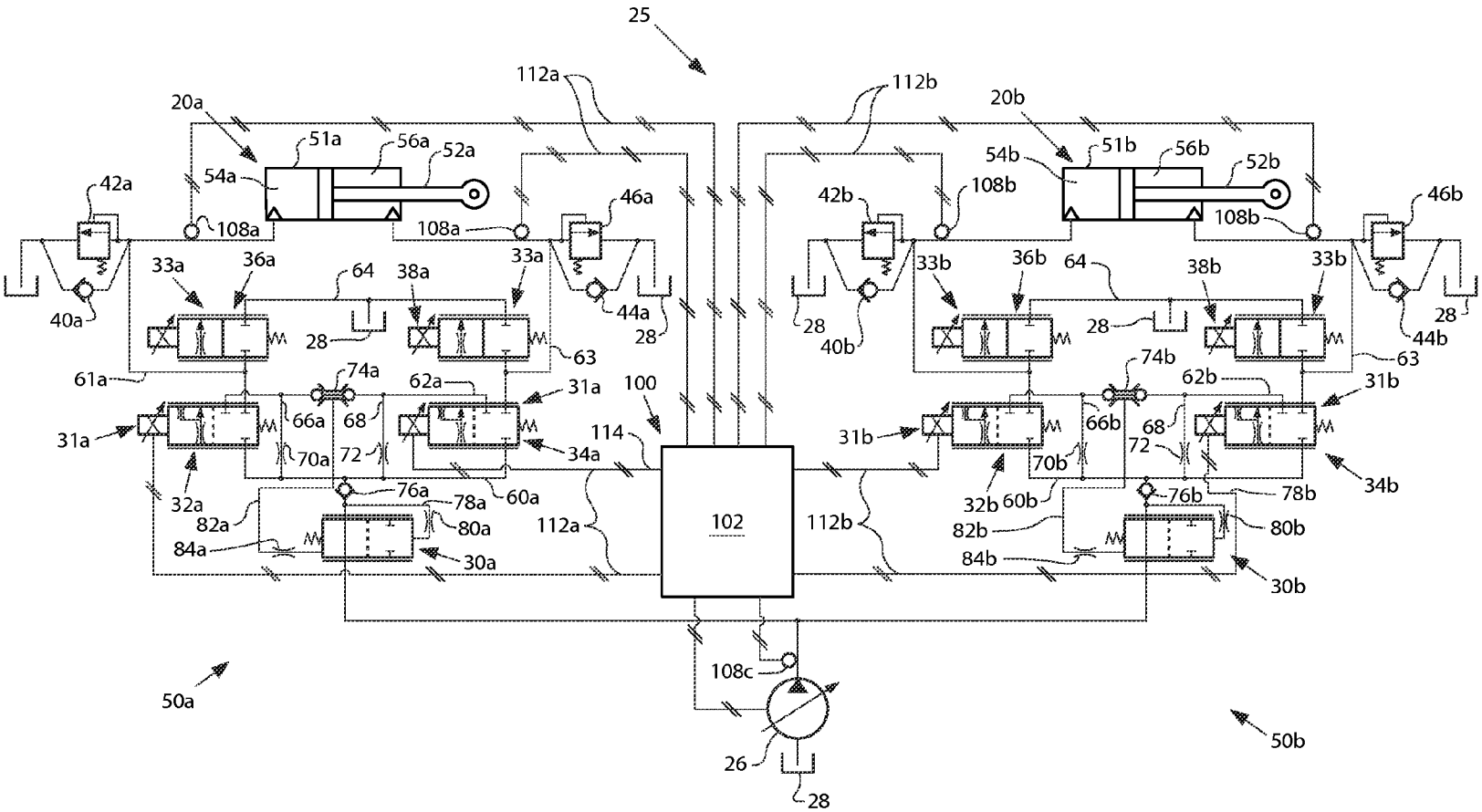
FIG. 2 is a schematic illustration of a disclosed hydraulic system.

As illustrated in FIG. 2, machine 10 may further include a hydraulic system 25 configured to affect movement of hydraulic actuators 20*a*, 20*b* so as to move, for example implement 14. Hydraulic system 25 may further include two hydraulic circuits 50*a*, 50*b* configured to control the operation of hydraulic actuators 20*a*, 20*b*, respectively.

Hydraulic system 25 may further include a source 26 of pressurized fluid and a tank 28. Hydraulic circuits 50*a*, 50*b*, may each include a pressure compensating valve 30*a*, 30*b*. Each hydraulic circuit 50*a*, 50*b* may further include two supply valves 31*a*, 31*b*: a head-end supply valve 32*a*, 32*b* and a rod-end supply valve 34*a*, 34*b*; as well as two drain valves 33*a*, 33*b*: a head-end drain valve 36*a*, 36*b*, and a rod-end drain valve 38*a*, 38*b*. Each hydraulic circuit may also include a head-end make-up valve 40*a*, 40*b*, a head-end relief valve 42*a*, 42*b*, a rod-end make-up valve 44*a*, 44*b*, and a rod-end relief valve 46*a*, 46*b*. It is contemplated that hydraulic system 25 may include additional and/or different components such as, for example, a temperature sensor, a position sensor, an accumulator, and/or other components known in the art.

Hydraulic actuators 20*a*, 20*b* may include a piston-cylinder arrangement, a hydraulic motor, and/or any other known hydraulic actuator having one or more fluid chambers therein. According to an embodiment of this disclosure, hydraulic actuators 20*a*, 20*b* may include a tube 51*a*, 51*b* and a piston assembly 52*a*, 52*b*. Hydraulic actuators 20*a*, 20*b* may also include a head-end chamber 54*a*, 54*b* and a rod-end chamber 56*a*, 56*b* separated by piston assembly 52*a*, 52*b*.

Source 26 may be configured to produce a flow of pressurized fluid and may include a variable displacement pump such as, for example, a swashplate pump, a variable pitch propeller pump, and/or other sources of pressurized fluid known in the art. Source 26 may be controlled by a control system 100 and may be drivably connected to a power source (not shown) of machine 10 by, for example, a countershaft (not shown), a belt (not shown), an electrical circuit (not shown), and/or in any other suitable manner. Source 26 may be disposed between tank 28 and hydraulic actuators 20*a*, 20*b* and may be configured to be controlled by control system 100.

Pressure compensating valves 30*a*, 30*b* may be proportional control valves disposed between source 26 and an upstream supply passageway 60*a*, 60*b*, respectively, and may be configured to control a pressure of the fluid supplied to upstream supply passageway 60*a*, 60*b*, respectively. Pressure compensating valves 30*a*, 30*b* may include a proportional valve element that may be spring and hydraulically biased toward a flow passing position and hydraulically biased toward a flow blocking position.

Pressure compensating valves 30*a*, 30*b* may be movable toward the flow blocking position by a fluid directed via a fluid passageway 78*a*, 78*b* from a point between pressure compensating valve 30*a*, 30*b* and upstream supply passageway 60*a*, 60*b*. A restrictive orifice 80*a*, 80*b* may be disposed within fluid passageway 78*a*, 78*b* to minimize pressure and/ or flow oscillations within fluid passageway 78*a*, 78*b*. Pressure compensating valve 30*a*, 30*b* may be movable toward the flow passing position by the combined forces of a spring and a fluid directed via a fluid passageway 82*a*, 82*b* from a shuttle valve 74*a*, 74*b*. A restrictive orifice 84*a*, 84*b* may be disposed within fluid passageway 82*a*, 82*b* to minimize pressure and/or flow oscillations within fluid passageway 82*a*, 82*b*. It is contemplated that the proportional valve element of pressure compensating valve 30*a*, 30*b* may alternately be spring biased toward a flow blocking position, that the fluid from fluid passageway 82*a*, 82*b* may alternately bias the valve element of pressure compensating valve 30*a*, 30*b* toward the flow blocking position, and/or that the fluid from passageway 78*a*, 78*b* may alternately move the proportional valve element of pressure compensating valve 30*a*, 30*b* toward the flow passing position. It is also contemplated that pressure compensating valve 30*a*, 30*b* may alternately be located downstream of supply valves 31*a*, 31*b*, or in any other suitable location. It is further contemplated that restrictive orifices 80*a*, 80*b*, and 84*a*, 84*b* may be omitted, if desired.

Supply valves 31*a*, 31*b* may be disposed between source 26 and hydraulic actuator 20*a*, 20*b*, respectively, and may be configured to regulate a flow of pressurized fluid to actuators 20*a*, 20*b*. Specifically, head-end supply valves 32*a*, 32*b* may be disposed between source 26 and head-end chamber 54*a*, 54*b*, and rod-end supply valves 34*a*, 34*b* may be disposed between source and rod-end chambers 56*a*, 56*b*, respectively. Depending on the direction of actuation of the actuator 20*a*, 20*b*, one of head-end supply valve 32*a*, 32*b* or rod-end supply valve 34*a*, 34*b* will provide the supply of pressurized fluid to the actuator 20*a*, 20*b* for its respective circuit 50*a*, 50*b*. For example, if pressurized fluid is provided to the head end 54*a* of actuator 20*a* in circuit 50*a*, head-end supply valve 32*a* would be the acting supply valve 31*a* in circuit 50*a*.

Supply valves 31*a*, 31*b* may each include a proportional valve element that may be spring biased and solenoid actuated to move the valve element to any of a plurality of positions from a first position in which fluid flow may be substantially blocked from flowing toward actuator 20*a*, 20*b* to a second position in which a maximum fluid flow may be allowed toward actuator 20*a*, 20*b*. Additionally, the proportional valve elements of supply valves 31*a*, 31*b* may be controlled by control system 100 to vary the size of a flow area through which the pressurized fluid may flow.

Drain valves 33*a*, 33*b* may be disposed between hydraulic actuator 20*a*, 20*b* and tank 28 and may be configured to regulate a flow of pressurized fluid from head-end chamber 54*a*, 54*b*, or rod-end chamber 56*a*, 56*b*, depending on the direction of actuation. Specifically, head-end drain valves 36*a*, 36*b* and rod-end drain valves 38*a*, 38*b* may each include a two-position valve element that may be spring biased and solenoid actuated between a first position at which fluid may be allowed to flow from head-end chamber 54*a*, 54*b* or rod-end chamber 56*a*, 56*b*, depending on the direction of actuation, and a second position at which fluid may be substantially blocked from flowing from head-end chamber 54*a*, 54*b* or rod-end chamber 56*a*, 56*b*. Supply valves 31*a*, 31*b* and drain valves 33*a*, 33*b* may be fluidly interconnected as illustrated in FIG. 2.

Shuttle valve 74*a*, 74*b* may be disposed within downstream system signal passageway 62*a*, 62*b*. Shuttle valve 74*a*, 74*b* may be configured to fluidly connect the one of head-end supply valve 32*a*, 32*b* and rod-end supply valve 34*a*, 34*b* having a lower fluid pressure to pressure compensating valve 30*a*, 30*b*. In this manner, shuttle valve 74*a*, 74*b* may resolve pressure signals from head-end supply valve 32*a*, 32*b* and rod-end supply valve 34*a*, 34*b* to allow the lower outlet pressure of the two valves to affect movement of pressure compensating valve 30*a*, 30*b* via fluid passageway 82*a*, 82*b*.

Hydraulic system 25 may include additional components to control fluid pressures and/or flows within hydraulic system 25. Specifically, hydraulic system 25 may include pressure balancing passageways 66*a*, 66*b* configured to control fluid pressures and/or flows within hydraulic system 25. Pressure balancing passageways 66*a*, 66*b* may fluidly connect upstream supply passageway 60*a*, 60*b* and downstream system signal passageway 62*a*, 62*b*. Pressure balancing passageways 66*a*, 66*b* may include restrictive orifices 70*a*, 70*b*, to minimize pressure and/or flow oscillations within fluid passageways 66*a*, 66*b*. Hydraulic system 25 may also include a check valve 76*a*, 76*b* disposed between pressure compensating valve 30*a*, 30*b* and upstream supply passageway 60*a*, 60*b* and may be configured to block pressurized fluid from flowing from upstream supply passageway 60*a*, 60*b* to pressure compensating valve 30*a*, 30*b*.

Control system 100 may be configured to control the operation of head-end supply valves 31*a*, 31*b* and drain valves 33*a*, 33*b* source 26. Control system 100 may include a controller 102 configured to receive pressure signals from pressure sensors 108*a*, 108*b* via communication lines 112*a*, 112*b*. Controller 100 may also be configured to deliver control signals to supply valves 31*a*, 31*b*, drain valves 33*a*, 33*b*, and source 26 via communication lines 112*a*, 112*b*. It is contemplated that the pressure and control signals may each be any conventional signal, such as, for example, a pulse, a voltage level, a magnetic field, a sound or light wave, and/or another signal format.

Controller 102 may be configured to control hydraulic system 25 in response to the pressure signals received from pressure sensors 108*a*, 108*b*, 108*c*. Controller 102 may be configured to perform one or more algorithms to determine appropriate output signals to control the movement of the valve elements of, and thus the amount of flow directed through, supply valves 31*a*, 31*b* and drain valves 33*a*, 33*b* and to control the output, e.g., displacement and/or input speed, of source 26. Controller 102 may determine the appropriate control signals by, for example, predetermined equations, look-up tables, and/or maps. It is further contemplated that controller 102 may control the operation of other components within hydraulic system 25.

In operation, source 26 provides pressurized fluid to either head-end chamber 54*a*, 54*b* or rod-end chamber 56*a*, 56*b* of one or more actuators 20*a*, 20*b*, depending on the direction of actuation. Flow of fluid to the actuator 20*a*, 20*b* may be controlled in part by control of source 26. For example, source 26 may be a variable displacement axial piston pump, in which case the rate of flow from source 26 may be controlled by the angle of the swashplate and/or the speed of the pump.

Flow of pressurized fluid from the source 26 to actuator 20*a*, 20*b* may also be controlled in part by the respective supply valve 31*a*, 31*b*. By altering the flow passing area of supply valve 31*a*, 31*b*, the flow of fluid to the respective actuator 20*a*, 20*b*, and the pressure drop over supply valve 31*a*, 31*b* may be controlled.

During operation, the flow available from source 26 may be limited, for example, by an actual maximum flow rate of source 26. For example, when each actuator 20*a*, 20*b* is operating at relatively low pressure, the source may operate in a non-power-limited state, in which the flow available from source could depend on, among other things, a maximum speed and displacement of source 26. However, if one or more of the actuators 20*a*, 20*b* is operating at a relatively high pressure, the source may operate in a power-limited state in which the flow available from source could be limited by available power. In a power-limited state available flow could depend on, among other things, an output pressure from source 26 and the power available to source 26. Generally, the actual available flow from source 26 will be less in a power-limited state as compared to a non-power-limited state.

When multiple circuits 50*a*, 50*b* simultaneously request flow to actuate multiple actuators 20*a*, 20*b*, controller 102 may apportion available flow from the source 26 to each of the multiple circuits 50*a*, 50*b* by controlling, for example, the supply valves 31*a*, 31*b* and/or drain valves 33*a*, 33*b* of the respective circuits. For example, controller 102 may control multiple supply valves 31*a*, 31*b*, to be actuated to provide a certain flow passing area, such that fluid will pass through the supply valves 31*a*, 31*b* at a desired rate, given a known pressure drop over the valve 31*a*, 31*b*.

Controller 102 may include logic that relates a set of inputs, such as an operator input or inputs, to flow passing position of supply valves 31*a*, 31*b*, and/or drain valves 33*a*, 33*b*. The logic may include a look-up table, an algorithm, priority schemes or other methods for relating inputs to desired flow passing positions of supply valves 31*a*, 31*b* as may be known in the art.

As discussed in greater detail below, when apportioning flow between multiple circuits 50*a*, 50*b*, the logic of controller 102 may be configured to assume a constant available flow rate in both power-limited and non-power-limited states.

INDUSTRIAL APPLICABILITY

The disclosed hydraulic system may be applicable to increase the efficiency of a machine 10. By configuring the controller 102 to assume a constant available flow rate in both power-limited and non-power-limited states the overall pressure demand on source 26 may be reduced, while maintaining appropriate levels of control and operator feedback.

Regarding an exemplary hydraulic system 25, a controller 102 may be configured to assume a constant available flow rate of 200 LPM. The source 26 of high pressure fluid in this exemplary system 25 may be capable of producing 200 LPM when operating at relatively low pressure and in a non-power-limited state. In this state, if one hydraulic circuit 50*a* requests 75 LPM of flow, and the other hydraulic circuit 50*b* requests 100 LPM of flow, the controller 102 may set a flow command equal to the minimum of the requested flow and the constant assumed available flow, which in this case would be the sum of the requested flow from each circuit, 175 LPM. In this case each circuit would receive the flow it requested. However, if the requested flow increased, for example, to 110 LPM and 125 LPM, the controller would utilize the assumed flow rate of 200 LPM, and set flow commands such that the sum of the flow command to each circuit 50*a*, 50*b* would substantially equal 200 LPM. The controller may utilize a prioritization scheme, algorithm, look-up table, or other methods known in the art for determining the ratio of flow provided to each circuit 50*a*, 50*b*.

To further this example, in a power-limited state, source 26 may, for example, only be capable of providing 150 LPM of flow. In this case, if circuit 50*a* is requesting 100 LPM and circuit 50*b* is requesting 125 LPM, controller will still apportion flow under the assumed available flow rate of 200 LPM, such that the flow passing areas of supply valves 31*a*, 31*b* will be sized as if the assumed available flow of 200 LPM was available. In this manner, the high-pressure circuit may have an oversized supply valve 31*a*, 31*b* or be stalled. In the first instance, the effect may be an overall reduction in system pressure caused by a reduced pressure drop over the supply valve 31*a*, 31*b* of the high-pressure circuit 50*a*, 50*b*. The overall reduction in system pressure may be compounded as a lower pressure drop over the supply valve 31*a*, 31*b* may also tend to bias the pressure compensating valve 30*a*, 30*b* towards a more open position, thereby reducing the pressure drop over the pressure compensating valve 30*a*, 30*b* as well. Alternatively, if the high-pressure circuit 50*a*, 50*b* stalls, the operator is provided with meaningful feedback regarding the state of the system, and may alter the command to relieve the stall.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system comprising:
- a source configured to provide pressurized fluid at an actual flow rate;
- a first hydraulic circuit configured to receive pressurized fluid from the source;
- a second hydraulic circuit configured to receive pressurized fluid from the source; and
- a controller configured to:
  - determine a requested flow for the first circuit;
  - determine a requested flow for the second circuit; and
  - apportion pressurized fluid from the source between the first circuit and the second circuit based on a predetermined assumed available flow rate, wherein the predetermined assumed available flow rate is greater than the actual flow rate of the source.

2. The hydraulic system of claim 1, wherein the predetermined assumed available flow rate is substantially equivalent to the actual flow rate of the source in a non-power-limited state.

3. The hydraulic system of claim 1, wherein the source is operating in a power-limited state.

4. The hydraulic system of claim 1, wherein the first hydraulic circuit is configured to control a flow of pressurized fluid to a first actuator and the second hydraulic circuit is configured to control a flow of fluid to a second actuator.

5. The hydraulic system of claim 4, wherein the controller apportions pressurized fluid from the source by controlling the size of a flow passing area of a first valve disposed between the source and the first actuator and the size of a flow passing area of a second valve disposed between the source and the second actuator.

6. The hydraulic system of claim 1, wherein the first hydraulic circuit includes a first actuator, a first supply valve disposed between the source and the first actuator and a first pressure compensating valve disposed between the source and the first supply valve.

7. The hydraulic system of claim 6, wherein the second hydraulic circuit includes a second actuator, a second supply valve disposed between the source and the second actuator and a second pressure compensating valve disposed between the source and the second supply valve.

8. A machine comprising:
- a frame;
- an implement;
- a source configured to provide pressurized fluid at an actual flow rate;
- a first hydraulic circuit configured to receive pressurized fluid from the source and having a first valve and a first actuator disposed between the frame and the implement, the first valve being disposed between the source and the first actuator;

a second hydraulic circuit configured to receive pressurized fluid from the source and having a second valve and a second actuator, the second valve being disposed between the source and the second actuator; and a controller configured to:

determine a requested flow for the first circuit;

determine a requested flow for the second circuit; and apportion pressurized fluid from the source between the first circuit and the second circuit based on a predetermined assumed available flow rate, wherein the predetermined assumed available flow rate is greater than the actual flow rate of the source.

9. The hydraulic system of claim 8, wherein the predetermined assumed available flow rate is substantially equivalent to the actual flow rate of the source in a non-power-limited state.

10. The hydraulic system of claim 9, wherein the source is operating in a power-limited state.

11. The hydraulic system of claim 8, wherein the controller apportions pressurized fluid from the source by controlling the size of a flow passing area of the first valve and the size of a flow passing area of the second valve.

12. The hydraulic system of claim 8, wherein the first hydraulic circuit includes a first pressure compensating valve disposed between the source and the first valve.

13. The hydraulic system of claim 12, wherein the second hydraulic circuit includes a second actuator, a second supply valve disposed between the source and the second actuator and a second pressure compensating valve disposed between the source and the second supply valve.

14. A method of controlling a hydraulic system having a source of pressurized fluid, a first circuit, and a second circuit comprising the steps:

determining a requested flow for the first circuit;

determining a requested flow for the second circuit; and apportioning pressurized fluid from the source between the first circuit and the second circuit based on a predetermined assumed available flow rate, wherein the predetermined assumed available flow rate is greater than an actual flow rate of the source.

15. The hydraulic system of claim 14, wherein the predetermined assumed available flow rate is substantially equivalent to the actual flow rate of the source in a non-power-limited state.

16. The hydraulic system of claim 14, wherein the source is operating in a power-limited state.

17. The hydraulic system of claim 14, further including the steps:

configuring the first hydraulic circuit to control a flow of pressurized fluid to a first actuator; and configuring the second hydraulic circuit to control a flow of fluid to a second actuator.

18. The hydraulic system of claim 17, wherein the step of apportioning pressurized fluid from the source is accomplished by controlling the size of a flow passing area of a first valve disposed between the source and the first actuator and by controlling the size of a flow passing area of a second valve disposed between the source and the second actuator.

19. The hydraulic system of claim 17, further including the step of providing a first pressure compensating valve disposed between the source and the first actuator.

20. The hydraulic system of claim 19, further including the step of providing a second pressure compensating valve disposed between the source and the second actuator.

* * * * *